US009434520B2

(12) United States Patent
Bates

(10) Patent No.: US 9,434,520 B2
(45) Date of Patent: Sep. 6, 2016

(54) CARTON WITH HANDLE

(71) Applicant: MeadWestvaco Packaging Systems, LLC, Richmond, VA (US)

(72) Inventor: Aaron L. Bates, Kennesaw, GA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/663,694

(22) Filed: Mar. 20, 2015

(65) Prior Publication Data

US 2015/0191286 A1 Jul. 9, 2015

Related U.S. Application Data

(63) Continuation of application No. 13/003,542, filed as application No. PCT/US2009/050805 on Jul. 16, 2009, now Pat. No. 9,199,775.

(60) Provisional application No. 61/081,632, filed on Jul. 17, 2008.

(51) Int. Cl.

| | |
|---|---|
| ***B65D 5/46*** | (2006.01) |
| ***B65D 5/468*** | (2006.01) |
| ***B65D 71/30*** | (2006.01) |
| ***B65D 71/36*** | (2006.01) |
| *B65D 71/32* | (2006.01) |

(52) U.S. Cl.

CPC ..... *B65D 71/30* (2013.01); *B65D 5/4608* (2013.01); *B65D 5/46096* (2013.01); *B65D 71/36* (2013.01)

(58) Field of Classification Search

CPC ..... B65D 5/4612; B65D 5/4608; B65D 5/46096; B65D 71/30; B65D 71/32; B65D 71/36

USPC ..... 229/117.13, 117.14, 117.16, 117.17

See application file for complete search history.

(56) References Cited

U.S. PATENT DOCUMENTS

| | | | | |
|---|---|---|---|---|
| 7,290,696 | B2 | 11/2007 | McClure | |
| 7,743,970 | B2 * | 6/2010 | Bates | B65D 5/4608 206/427 |
| 7,775,418 | B2 | 8/2010 | Walling | |
| 7,832,621 | B2 | 11/2010 | Smalley | |
| 7,883,000 | B2 | 2/2011 | Sheffield et al. | |
| 7,959,062 | B2 | 6/2011 | Auclair | |
| 8,061,587 | B2 | 11/2011 | Blin | |
| 8,523,047 | B2 | 9/2013 | Holley, Jr. | |
| 9,199,775 | B2 * | 12/2015 | Bates | B65D 5/4608 |
| 2004/0159569 | A1 | 8/2004 | Mahood | |
| 2006/0081691 | A1 | 4/2006 | Smalley | |
| 2006/0278689 | A1 | 12/2006 | Boshinski | |
| 2007/0131748 | A1 | 6/2007 | Brand | |
| 2008/0257943 | A1 | 10/2008 | Blin | |
| 2009/0001148 | A1 | 1/2009 | Holley, Jr. | |

FOREIGN PATENT DOCUMENTS

| | | |
|---|---|---|
| AU | 2008304118 | 4/2009 |
| EP | 1017598 | 7/2000 |
| WO | WO 2007/022482 | 2/2007 |
| WO | WO 2007/044719 | 4/2007 |

* cited by examiner

*Primary Examiner* — Gary Elkins

(74) *Attorney, Agent, or Firm* — WestRock Intellectual Property Group

(57) ABSTRACT

A carton has composite wall which includes a handle that has a handle opening. The handle opening is defined at least in part by a load bearing edge. The load bearing edge includes a first segment to which a first handle flap is hingedly connected along a first fold line, and second and third segments to which second and third handle flaps are hingedly connected along second and third fold lines respectively. The first handle flap is formed from the outer layer. The second and third handle flaps are formed from the inner layer. The second and third fold lines are spaced apart from each other with a free edge of the inner layer extending between the second and third fold lines.

20 Claims, 6 Drawing Sheets

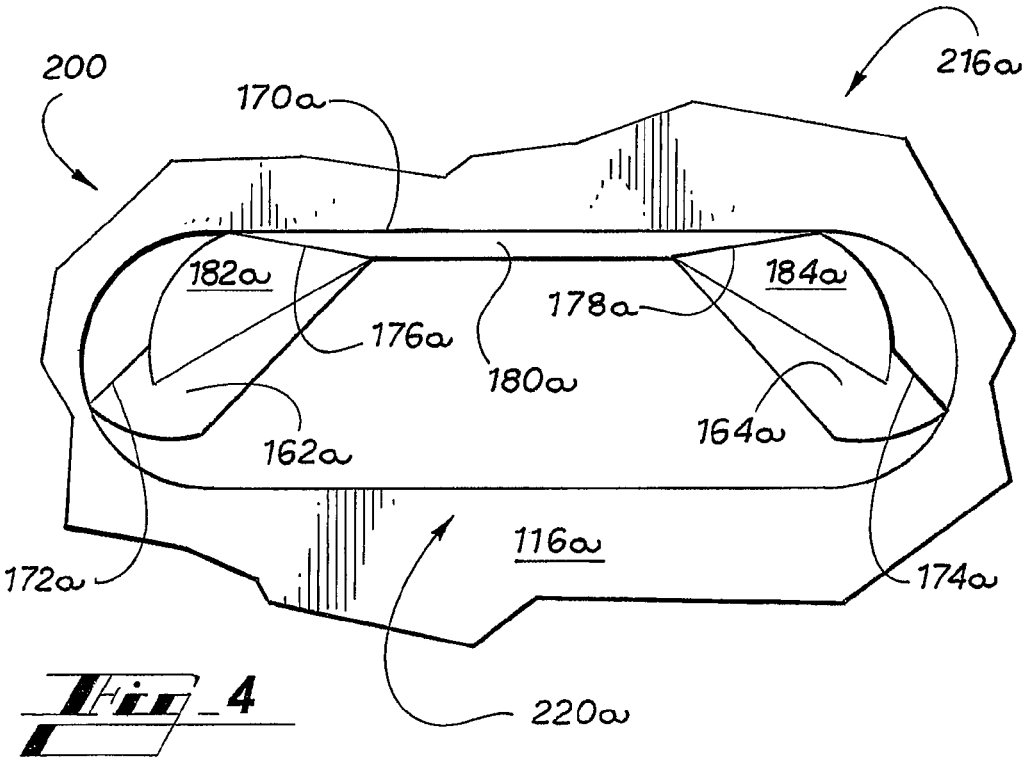
Fig. 4
Fig. 5
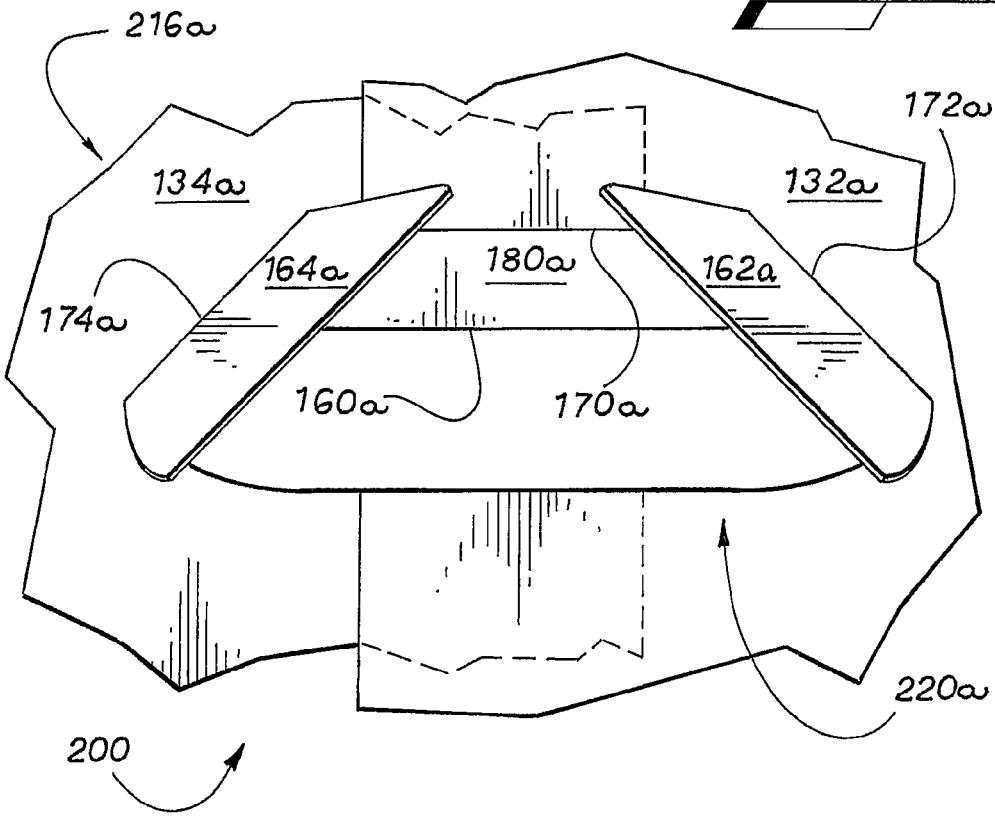

CARTON WITH HANDLE

TECHNICAL FIELD

This invention relates generally to cartons and, more specifically, to cartons with handles.

BACKGROUND

Cartons for packaging articles such as soft drink cans or bottles are useful to enable consumers to transport and store the articles. The cartons generally include one or more handles to facilitate gripping and carrying the carton to transport the articles. As groups of articles can be heavy, it is desired that the handles are comfortable and easy to engage. Certain known handle designs include a load-bearing edge that is uncomfortable. For example, load-bearing edges that are formed with a cut line can be uncomfortable when pressed against a user's hand. Therefore, a heretofore unaddressed need exists in the industry to address the aforementioned deficiencies and inadequacies.

SUMMARY

The various embodiments of the present invention overcome the shortcomings of the prior art by providing a handle that is configured to provide a comfortable load-bearing edge. The load-bearing edge is configured to compensate for both horizontal forces and vertical forces that can be applied by the handle to a user's hand. For example, vertical forces may be due to the weight of the articles and horizontal forces may be due to carrying the carton at a slight angle or swinging, pushing, pulling, or sliding the carton. With such movements, the load-bearing edge includes top and side edges that the user can engage to move the carton or that can come into contact with a user's hand while engaging the handle.

Generally described, the handle includes an aperture or opening defined in a wall of a carton that allows a user to insert fingers or another portion of a hand therethrough. The opening is generally sized to fit a user's hand and can have various shapes including an elongated slot, trapezoidal, and rectangular. The handle also includes an arrangement of handle flaps that are configured to provide cushioning along the load-bearing edge of the handle. According to an exemplary embodiment, a top handle flap is hingedly connected to a top edge of the handle and side handle flaps are hingedly connected to respective side edges of the handle. The top handle flap and the side handle flap are folded toward the interior of the carton when the handle is engaged and hinged connections of the folded handle flaps cushion the load-bearing edge of the handle.

According to one aspect of the disclosure, an arrangement of handle flaps is configured to fold as a unit. For example, when a first handle flap is folded toward the interior of the carton, the first handle flap folds a second handle flap toward the interior of the carton. According to an exemplary embodiment, an end of a first fold line that hingedly connects the first handle flap to an edge of the handle is adjacent to an end of a second fold line that hingedly connects the second handle flap to the edge of the handle and the first handle flap overlaps the second handle flap.

According to an exemplary embodiment of the disclosure, a wall in which the handle is formed can be a composite wall where an outer handle aperture formed in an outer layer is in registry with an inner handle aperture formed in an inner layer. An outer handle flap is attached to an edge of the outer handle aperture and an inner handle flap is attached to an edge of the inner handle aperture. In an unfolded condition, a portion of the outer handle flap may overlap a portion of the inner handle flap. Accordingly, when the outer handle flap is folded, the outer handle flap can contact the inner handle flap to fold the inner handle flap toward the interior of the carton. Additionally, the outer handle flap can include a portion that folds such that the outer handle flap and the inner handle flap remain in contact as they are each folded toward the interior of the carton. In other words, the outer handle flap and the inner handle flap fold as a unit toward the interior of the carton.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION OF THE SEVERAL VIEWS OF THE DRAWINGS

FIG. 4 is a partial perspective view of the exterior of the handle of FIG. 3, the handle being in a folded condition.

FIG. 5 is a partial perspective view of the interior of the handle of FIG. 4.

DETAILED DESCRIPTION

Figure 1:
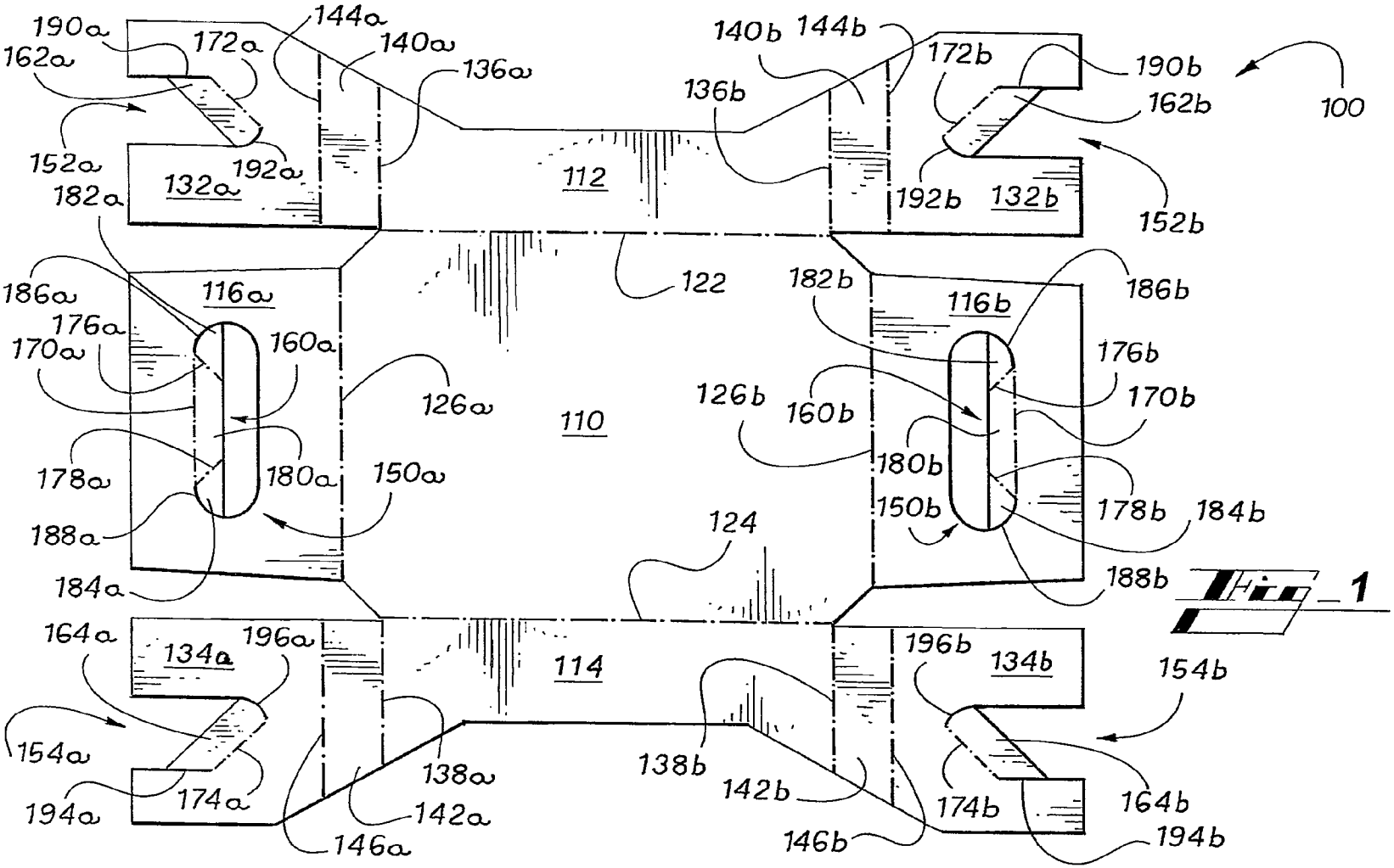
FIG. 1 is a plan view of a blank for forming a carton, according to a first exemplary embodiment of the disclosure.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of a carton. In the embodiments detailed herein, the term carton refers, for the non-limiting purpose of illustrating the various features of the invention, to a container for grouping, carrying, and dispensing articles, such as beverage cans or bottles. However, it is contemplated that the teachings of the disclosure can be applied to other containers. Generally described, one of the illustrated embodiments is a "tray-style" carton and another of the illustrated embodiments is a "box style" carton.

Referring to a first exemplary embodiment illustrated in FIGS. 1-5, a "tray-style" carton 200 (FIG. 2) is formed from a blank 100 (FIG. 1). The illustrated blank 100 is a single sheet of suitable substrate. As used herein, the term "suitable substrate" includes all manner of foldable sheet material including paperboard, corrugated board, cardboard, plastic, combinations thereof, and the like. In the illustrated embodiments, a unitary blank is used to form a carton, although it should be recognized that two or more blanks may be used to form a carton. The illustrated blanks are each configured to form a carton for packaging an exemplary arrangement of exemplary articles. It is envisaged that the blanks can be alternatively configured to form a carton for packaging other articles and/or different arrangements of articles.

As used herein, the term "fold line" refers to all manner of lines that define hinge features of the blank, facilitate folding portions of the blank with respect to one another, or otherwise indicate optimal panel folding locations for the blank. A fold line may be a scored line, an embossed line, or a debossed line.

As used herein, the term "severance line" refers to all manner of lines that facilitate separating portions of the substrate from one another or that indicate optimal separation locations. A severance line may be a frangible or weakened line, a cut line, or a slit.

It should be understood that severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can have different degrees of weakness such that the line of perforations can be a fold line and/or a severance line. In other words, the line of perforations can be designed to facilitate folding and resist breaking, to facilitate folding and facilitate breaking with more effort, or to facilitate breaking with little effort.

Referring to FIG. 1, the blank 100 includes a base panel 110, side panels 112, 114 hingedly connected to side edges of the base panel 110, and end panels 116*a*, 116*b* hingedly connected to end edges of the base panel 110. The side panels 112, 114 are hingedly connected to the base panel 110 along fold lines 122, 124 and the end panels 116*a*, 116*b* are hingedly connected to the base panel 110 along fold lines 126*a*, 126*b*.

The blank 100 is substantially symmetric such that opposed ends thereof are substantially similar. For clarity, like references have been used with a suffix "a" or "b" affixed to distinguish one end of the blank 100 from the other. The description of an element or group of elements having a suffix "a" is generally suitable for a like-numbered element or group of elements having a suffix "b". In certain instances, only one of like elements may be described unless a description of other or all of the like elements is useful for understanding the invention.

Side end flaps 132*a*, 132*b*, 134*a*, 134*b* are hingedly connected to opposed ends of side panels 112, 114 along fold lines 136*a*, 136*b*, 138*a*, 138*b*, respectively. In the illustrated embodiment, the side end flaps 132*a*, 134*a* include corner panels 140*a*, 142*a* that are defined by the fold line 136*a*, 138*a* and a fold line 144*a*, 146*a*.

The blank 100 further includes elements that combine to provide handles at opposed ends of the carton 200. The end panel 116*a* includes a handle aperture 150*a* and the side end flaps 132*a*, 134*a* include handle notches 152*a*, 154*a*. Each of the handle aperture 150*a* and the handle notches 152*a*, 154*a* include a handle flap attached along an edge thereof. The handle aperture 150*a* includes a top handle flap 160*a* and the handle notches 152*a*, 154*a* include side handle flaps 162*a*, 164*a*, respectively. The top handle flap 160*a* is hingedly connected to a top edge of the handle aperture 150*a* along a fold line 170*a* and the side handle flaps 162*a*, 164*a* are hingedly connected to side edges of the handle notches 152*a*, 154*a* along fold lines 172*a*, 174*a*, respectively.

The top handle flap 160*a* includes fold lines 176*a*, 178*a* that define a main portion 180*a* and side portions 182*a*, 184*a*. The main portion 180*a* is hingedly connected to the top edge of the handle aperture 150*a* and the side portions 182*a*, 184*a* are separable from the end panel 116*a* along severance lines 186*a*, 188*a*. The side handle flaps 162*a*, 164*a* are separable from the side end flaps along severance lines 190*a*, 192*a*, 194*a*, 196*a*.

The fold lines 172*a*, 174*a* and the fold lines 176*a*, 178*a* are configured such that the top handle flap 160*a* and the side handle flaps 162*a*, 164*a* cooperate as described in further detail below.

Figure 2:
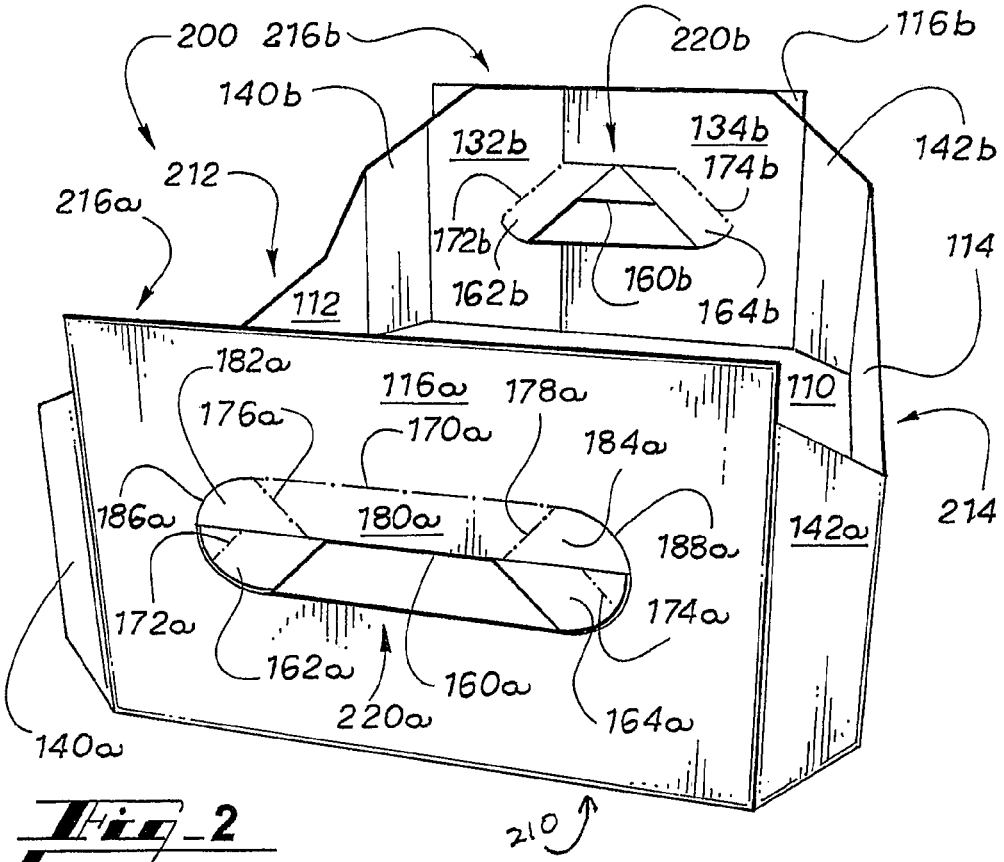
FIG. 2 is a perspective view of a carton formed from the blank of FIG. 1.

Referring to FIGS. 1 and 2, an exemplary method of folding and securing the blank 100 to form the carton 200 is now described although a method of erecting the carton 200 is not limited to the steps described herein. Rather, the order of the steps can be altered according to manufacturing requirements, steps may be added or omitted, and means for securing components to one another may vary. For example, although the surfaces of sheet material together are described as being glued together, the sheet material may alternatively be secured together by tape, staples, interlocking folds, hook and loop fasteners, other adhesives, combinations thereof, and the like. The exemplary method can be performed by automatic erecting machinery and/or manually.

The side panels 112, 114 are folded along the fold lines 122, 124 so as to be substantially perpendicular to the base panel 110. The side end flaps 132*a*, 134*a* are then folded along fold lines 136*a*, 138*a*, 144*a*, 146*a* such that the distal end portions of the side end flaps 132*a*, 134*a* overlap and such that the corner panels 140*a*, 142*a* align with chamfered corners of the base panel 110. The overlapping distal end portions of the side end flaps 132*a*, 134*a* are secured together with glue. The end panel 116*a* is then folded along the fold line 126*a* to overlap exposed outer surfaces of the end wall portions of the side end flaps 132*a*, 134*a* and is secured thereto with glue. In alternative embodiments, the side end flaps do not overlap or are not secured together although the notches approximate an aperture formed in an inner layer defined by the side end flaps as in the first exemplary embodiment. Further, the side end flaps 132*a*, 134*a* can form an outer layer of an end wall.

The side end flaps 132*a*, 134*a* and end panel 116*a* are thus secured together to provide a composite end wall 216*a* of the carton 200. Similarly, the side end flaps 132*b*, 134*b* and end panel 116*b* are secured together to provide a composite end wall 216*b* of the carton 200. Additionally, the erected side panels 112, 114 provide side walls 212, 214 of the carton 200 and the base panel 110 provides a base wall 210 of the carton 200.

Figure 3:
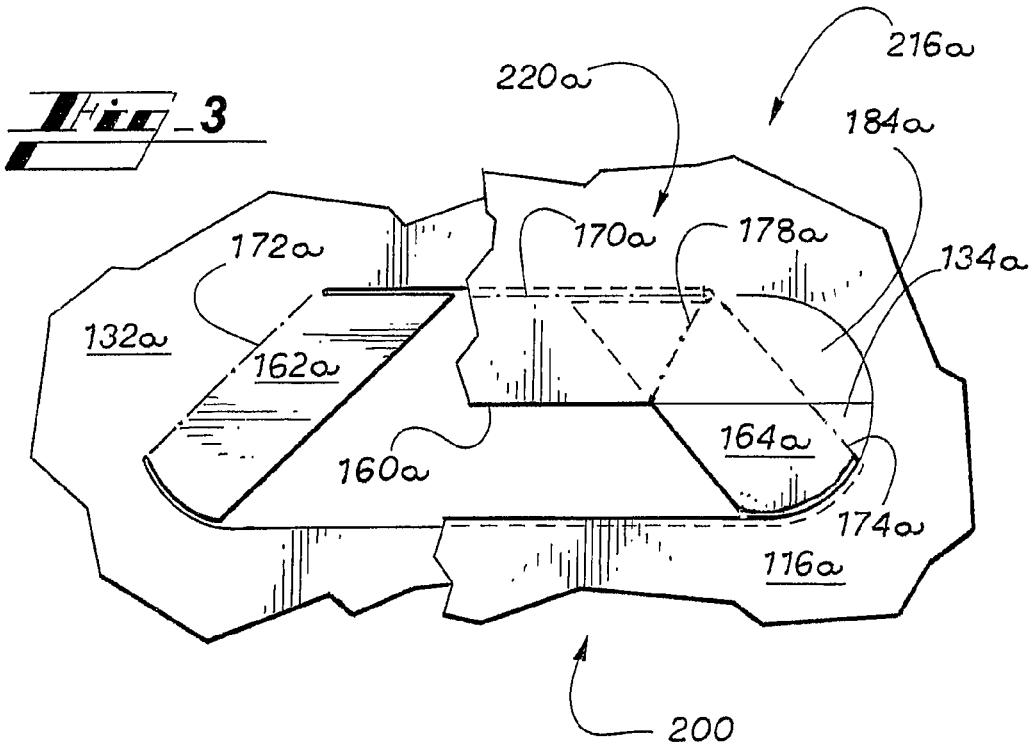
FIG. 3 is a partial end elevation view of a handle of the carton of FIG. 2, the handle being in an unfolded condition.

Referring to FIGS. 2 and 3, each of the end walls 216*a*, 216*b* includes a handle 220*a*, 220*b*. The illustrated handle 220*a* is formed as the handle aperture 150*a* and the handle notches 152*a*, 154*a* are brought into registry with one another and the top handle flap 160*a* and the side handle flaps 162*a*, 164*a* are arranged to cooperate with one another. The handle notches 152*a*, 154*a* provide an inner handle aperture with edges that are offset from the edges of the aperture 150*a*. Accordingly, the illustrated handle 220*a* has an edge that is partially defined by edges of the aperture 150*a* and partially defined by edges of the notches 152*a*, 154*a*. For example, the side edges of the notches 152*a*, 154*a* defined by fold lines 172*a*, 174*a* are offset from the side edges of the aperture 150*a* and define the side edges of the handle 220*a*. The trapezoidal shape of the handle 220*a* distributes the force applied to carry the carton 200 and thus limits the concentration of stress that is typically observed at the corners of slot handles.

The illustrated arrangement of handle flaps is such that the top handle flap 160*a* overlaps the side handle flaps 162*a*, 164*a* and portions of the side end flaps 132*a*, 134*a*. The main portion 180*a* overlaps the side handle flaps 162*a*, 164*a* and side portions 182*a*, 184*a* of the top handle flap 160*a* overlap the side handle flaps 162*a*, 164*a* and the side end flaps 132*a*, 134*a*. The inner layer provided by the side end flaps 132*a*, 134*a* permits the main portion 180*a* to fold inwardly and facilitates folding the side portions 182*a*, 184*a*.

The illustrated fold lines 172*a*, 174*a*, 176*a*, 178*a* are arranged to facilitate folding the top handle flap 160*a* and the side handle flaps 162*a*, 164*a* as a unit. The fold lines 172*a*, 174*a* upwardly extend convergently towards one another while the fold lines 176*a*, 178*a* upwardly extend divergently away from one another.

Figure 9:
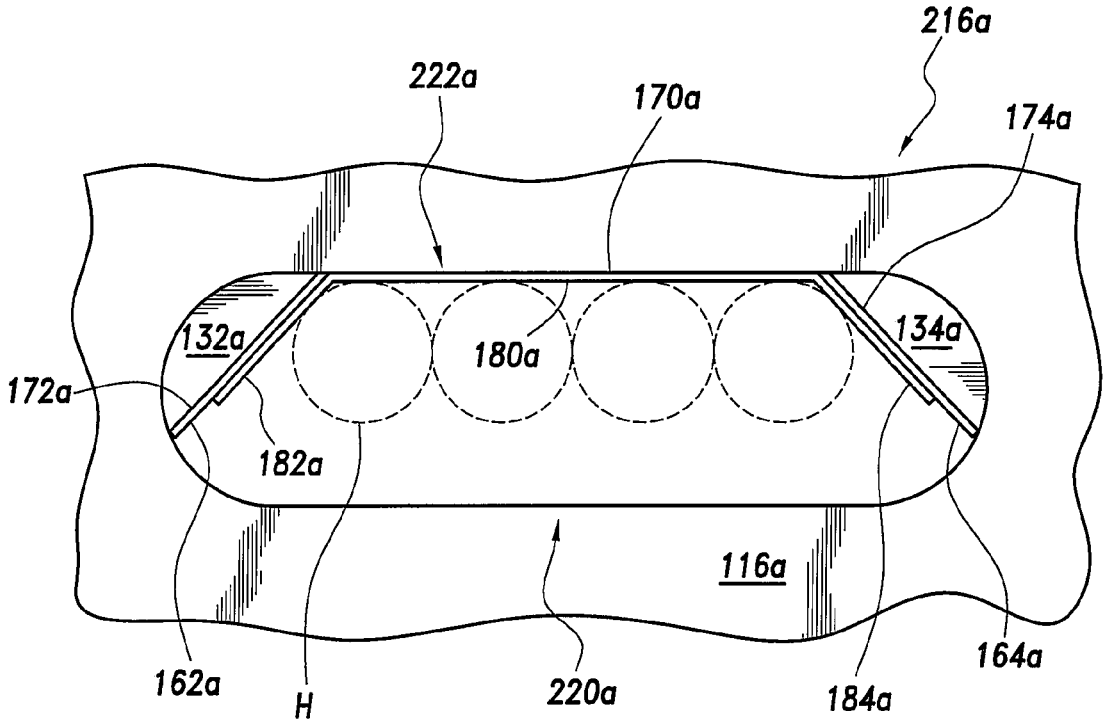
FIG. 9 is a partial end elevation view of the handle of FIG. 3 illustrating the insertion of a hand into the handle.

The upper ends of the fold lines 172*a*, 174*a* are adjacent to opposite ends of the fold line 170*a* respectively. Typically, the fold lines 170*a* and 172*a*, 174*a* do not substantially overlap or intersect one another. Each of the illustrated fold lines 172*a*, 174*a* is disposed at an obtuse angle with respect to the fold line 170*a*. The angle of the fold lines 172*a*, 174*a* contributes to the concave load bearing edge and concave support surface of the handle 220*a* as viewed from the base of the carton, which is best illustrated in FIGS. 4 and 9. In alternative embodiments, the angle between one of the fold lines 172*a*, 174*a* and the fold line 170*a* can be acute or substantially equal to ninety degrees.

Referring to FIGS. 2-5 and 9, an exemplary method of operation of the handle 220*a* is now described. The handle 220*a* can be engaged by inserting a hand H into the handle opening (FIG. 9) and folding the main portion 180*a* of the top handle flap 160*a* inwardly along the fold line 170*a* (FIGS. 4, 5, and 9). As the main portion 180*a* is folded inwardly, the main portion 180*a* contacts and folds the side handle flaps 162*a*, 164*a* inwardly along the fold lines 172*a*, 174*a*. Substantially simultaneously, the side portions 182*a*, 184*a* of the top handle flap 160*a* fold along the fold lines 176*a*, 178*a*. The side portions 182*a*, 184*a* initially fold due to contact with the side end flaps 132*a*, 134*a* and additionally fold as they come into contact with the side handle flaps 162*a*, 164*a*. As the main portion 180*a* is folded so as to be substantially perpendicular to the end wall 216*a*, the side portions 182*a*, 184*a* and the side handle flaps 162*a*, 164*a* contact one another and retain one another in folded conditions. As such, the top handle flap 160*a* and the side handle flaps 162*a*, 164*a* fold as a unit.

Referring to FIGS. 3 and 9, the handle 220*a* includes a load-bearing edge 222*a* that is configured to cushion a user's hand against both vertical and horizontal loads that are applied by the handle 220*a*. The illustrated load-bearing edge 222*a* includes the top and side edges of the handle 220*a* that are defined by fold lines 170*a*, 172*a*, 174*a*. The illustrated load-bearing edge 222*a* also includes top and side support surfaces of the handle 220*a* that are provided by the main portion 180*a*, the side portions 182*a*, 184*a*, and the side handle flaps 162*a*, 164*a*. The top and side edges of the handle 220*a* are substantially continuous and the top and side surfaces of the handle 220*a* are substantially continuous (see FIG. 4).

Figure 6:
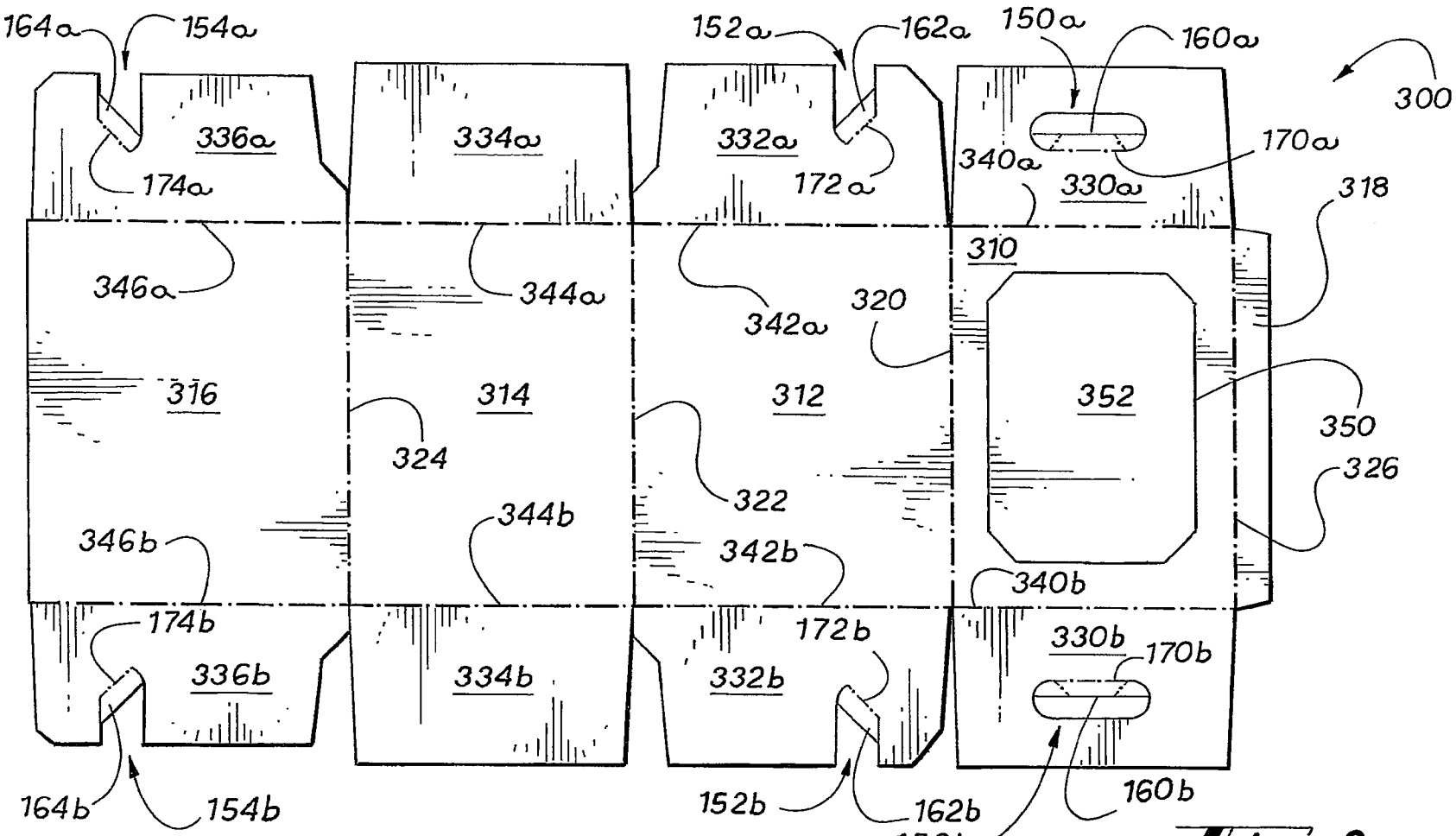
FIG. 6 is a plan view of a blank for forming a carton, according to a second exemplary embodiment of the disclosure.

Turning to FIG. 6, a second exemplary embodiment of the disclosure is illustrated. The illustrated blank 300 can be folded and secured to form an end loadable and more fully enclosed carton (not shown). The blank 300 includes elements that are substantially similar to those of the handle of the first exemplary embodiment and for clarity the same numerals have been used to identify the handle of the second exemplary embodiment.

The blank 300 includes a series of primary panels which define the walls of a tubular structure of a carton (not shown). The primary panels are aligned along a longitudinal axis of the blank 300 and are hingedly connected one to the next along fold lines that extend transversely with respect to the longitudinal axis. Specifically, the primary panels include a top panel 310, a first side panel 312, a base panel 314, and a second side panel 316. The top panel 310 is hingedly connected to the first side panel 312 along a fold line 320, the first side panel 312 is hingedly connected to the base panel 314 along a fold line 322, and the base panel 314 is hingedly connected to the second side panel 316 along a fold line 324. The blank 300 further includes an edge flap 318 that facilitates securing the endmost primary panels to one another. In the exemplary embodiment, the edge flap 318 is hingedly connected to the top panel 310 along a fold line 326.

End flaps are hingedly connected to opposite ends of each primary panel along fold lines. The end flaps can be folded and secured to form end closure structures at respective open ends of the tubular structure of the carton and thereby define end walls of the carton. Top end flap 330*a* is hingedly connected to top panel 310 along fold line 340*a*, first side end flap 332*a* is hingedly connected to first side panel 312 along fold line 342*a*, bottom end flap 334*a* is hingedly connected to base panel 314 along fold line 344*a*, and second side end flap 336*a* is hingedly connected to second side panel 316 along fold line 346*a*.

The top end flap 330*a* includes a handle aperture 150*a* with a top handle flap 160*a* attached to the top edge thereof along a fold line 170*a* and the side end flaps 332*a*, 336*a* include side handle flaps 162*a*, 164*a* attached to side edges thereof along fold lines 172*a*, 174*a*.

The blank 300 includes a severance line 350 that defines a detachable portion 352 of the blank 300. The detachable portion 352 is dimensioned and positioned such that, as the blank 300 is erected to form the carton, the detachable portion 352 can be at least partially separated from the carton to provide an opening in the carton through which articles can be dispensed. The detachable portion 352 can have any size or shape so as to provide a suitable opening for dispensing articles and the illustrated version is provided as a non-limiting example.

The blank 300 can be folded and secured to form a collapsed tubular structure by folding the edge flap 318 along the fold line 326 such that the inside surface of the edge flap 318 is in flat face contact with the inside surface of the top panel 310, applying glue or other adhesive to the outside surface of the edge flap 318, and folding the blank 300 along the fold line 322 such that the inside surface of the second side panel 316 is in flat face contact with, and thereby secured to, the outside surface of the edge flap 318. A tubular structure can thereafter be erected from the collapsed tubular structure. The primary panels form the walls of the tubular structure. The tubular structure of the carton includes open ends through which articles can be loaded. It should be understood that the end flaps can be folded outwardly or otherwise so as not to obstruct articles as they are loaded through one or both of the open ends.

The end closure structures of the carton are formed by folding the end flaps as described herein. Side end flaps 332*a*, 336*a* are folded inwardly toward the open end of the tubular structure along fold lines 342*a*, 346*a* so as to be substantially coplanar with one another. Top and bottom end flaps 330*a*, 334*a* are folded inwardly toward to the open end of the tubular structure along fold lines 340*a*, 344*a* to be substantially coplanar with one another. The top and bottom end flaps 330*a*, 334*a* overlap the side end flaps 332*a*, 336*a* and glue is applied to the overlapping portions of the end flaps such that the end flaps can be secured together to form an end closure structure. Thereby, the end closure structures of the carton are formed and the carton is fully erected. The primary panels that define the tubular structure portion and the end closure structures define the walls of the carton. Handles that are substantially similar to those described above and illustrated in FIGS. 3-5 are formed in the end closure structures of the carton.

Figure 8:
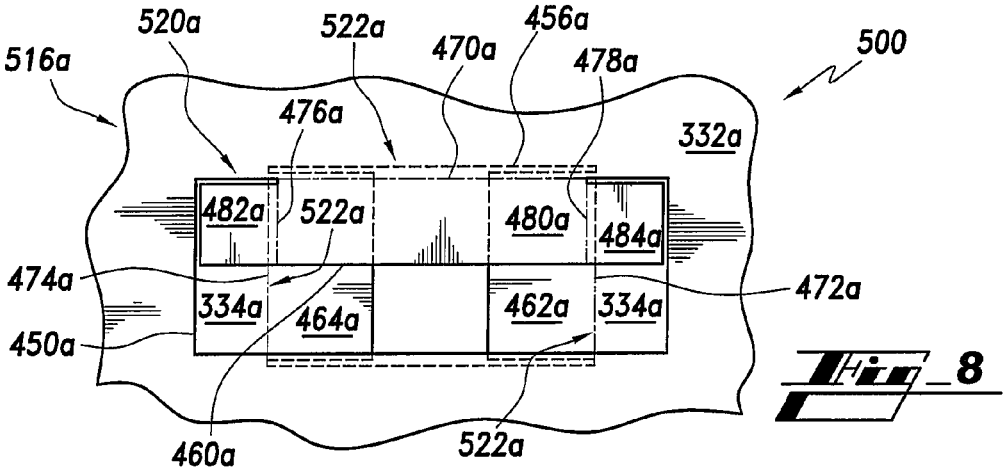
FIG. 8 is a partial end elevation view of a handle of the carton of FIG. 7.
Figure 7:
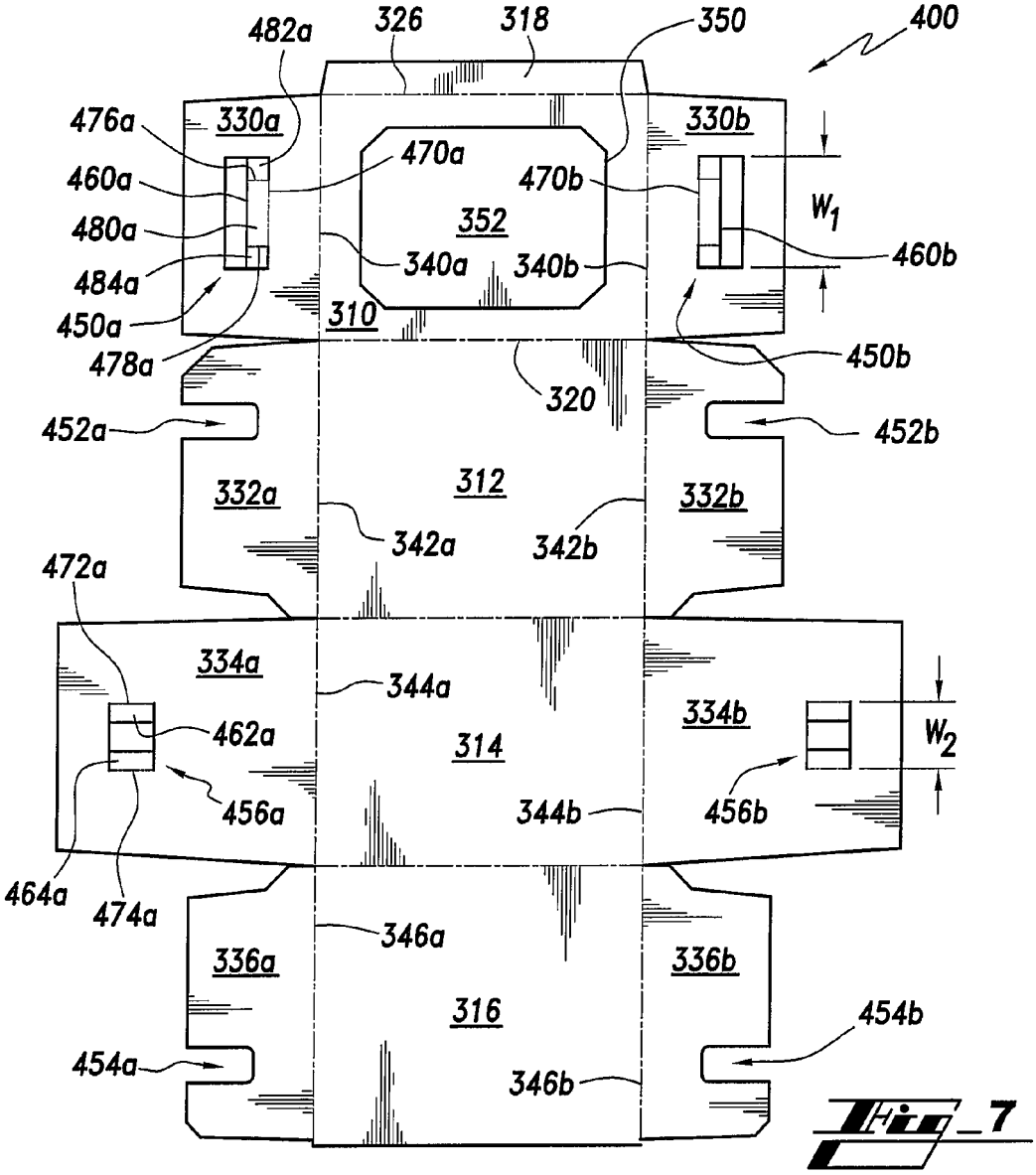
FIG. 7 is a plan view of a blank for forming a carton, according to a third exemplary embodiment of the disclosure.

Referring to FIGS. 7 and 8, a third exemplary embodiment of the disclosure is illustrated that includes an alternative configuration of a handle 520*a*. The blank 400 is substantially similar to the blank 300 and like numerals will be used to identify like elements although certain of the elements are alternatively configured. The description of the blank 400 will be directed to the alternatively configured elements.

The blank 400 includes a top end flap 330*a* and a bottom end flap 334*a* that are configured such that an outer handle aperture 450*a* of the top end flap 330*a* and an inner handle aperture 456*a* of the bottom end flap 334*a* are in registry when the top end flap 330*a* and the bottom end flap 334*a* overlap to form and end closure structure. In the illustrated embodiment, the width W1 of the outer handle aperture 450*a* is greater than the width W2 of the inner handle aperture 456*a*. An outer handle flap 460*a* is hingedly connected to the top edge of the outer handle aperture 450*a* along a fold line 470*a* and inner handle flaps 462*a*, 464*a* are hingedly connected to side edges of the inner handle aperture 456*a* along fold lines 472*a*, 474*a*. The outer handle flap 460*a* includes fold lines 476*a*, 478*a*.

Referring to FIG. 8, a carton 500 formed from the blank 400 includes an end wall 416*a* that includes a handle 520*a*. The handle 520*a* includes the outer handle aperture 450*a* in registry with the inner handle aperture 456*a* and the outer handle flap 460*a* and the inner handle flaps 462*a*, 464*a* configured to fold as a unit and provide a cushioned load-bearing edge 522*a* of the handle 520*a*. In the illustrated embodiment, the fold lines 476*a*, 478*a* are substantially adjacent and parallel to the fold lines 472*a*, 474*a*. A main portion 480*a* of the outer handle flap 460*a* has a width that is less than the width W2 of the inner handle aperture 456*a* and side portions 482*a*, 484*a* overlap the bottom end flap 334*a*.

The present invention has been illustrated in relation to a particular embodiment which is intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

The invention claimed is:

1. A carton comprising:

a composite wall comprising a handle that includes a handle opening, the handle opening being defined at least in part by a load bearing edge, the load bearing edge comprising:

a first segment to which a first handle flap is hingedly connected along a first fold line: and second and third segments to which second and third handle flaps are hingedly connected along second and third fold lines respectively, wherein the composite wall comprises an inner layer and an outer layer, the first handle flap being formed from the outer layer, the second and third handle flaps being formed from the inner layer, the second and third fold lines being spaced apart from each other with a free edge of the inner layer extending between the second and third fold lines, and wherein the free edge is disposed in substantial alignment with the first fold line.

2. The carton of claim 1, wherein no part of the inner layer is hingedly connected to the free edge.

3. The carton of claim 2, wherein the second and third handle flaps extend from the second and third fold lines into the handle opening when the handle is in an unfolded condition.

4. The carton of claim 3, wherein the second and third handle flaps are disposed behind the first handle flap.

5. The carton of claim 1, wherein at least part of the first handle flap is disposed out of contact with the second and third handle flaps when the handle is in the folded condition.

6. The carton of claim 5, wherein the first handle flap comprises a main portion extending along the first fold line and opposed side portions extending continuously from the main portion longitudinally beyond opposed ends of the first fold line respectively, the side portions being disposed to be substantially in flat face contact with the second and third handle flaps when the handle is in a folded condition.

7. The carton of claim 6, wherein the first handle flap further comprises additional fold lines, and the side portions are hingedly connected to the main portion along the additional fold lines respectively.

8. The carton of claim 6, wherein the main portion of the first handle flap is disposed entirely out of contact with the second and third handle flaps when the handle is in the folded condition.

9. A carton comprising;

a composite wall comprising a handle that includes a handle opening, the handle opening being defined at least in part by a load bearing edge, the load bearing edge comprising;

a first segment to which a first handle flap is hingedly connected along a first fold line; and second and third segments to which second and third handle flaps are hingedly connected along second and third fold lines respectively, wherein the composite wall comprises an inner layer and an outer layer, the first handle flap being formed from the outer layer, the second and third handle flaps being formed from the inner layer, the second and third fold lines being spaced apart from each other with a free edge of the inner layer extending between the second and third fold lines, wherein the second handle flap extends from the second fold line to a free end edge of the second handle flap, the free end edge of the second handle flap extends substantially across the first handle flap when the handle is in an unfolded condition.

10. The carton of claim 9, wherein the third handle flap extends from the third fold line to a free end edge of the third handle flap, the free end edge of the third handle flap extends substantially across the first handle flap when the handle is in an unfolded condition.

11. A carton comprising:

a composite wall comprising a handle that includes a handle opening, the handle opening being defined at least in part by a load bearing edge, the load bearing edge comprising:

a first segment to which a first handle flap is hingedly connected along a first fold line; and second and third segments to which second and third handle flaps are hingedly connected along second and third fold lines respectively, wherein the composite wall comprises an inner layer and an outer layer, the first handle flap being formed from the outer layer, the second and third handle flaps being formed from the inner layer, the second and third fold lines being spaced apart from each other, and wherein the first handle flap is disposed in contact with both the first and second handle flaps and partially not in contact with either one of the second and third handle flaps when the handle is in an unfolded condition.

12. The carton of claim 11, wherein the inner layer comprises first and second panel portions disposed side by side in substantially the same plane, the second handle flap being formed from the first panel portion, and the third handle flap being formed from the second panel portion.

13. The carton of claim 12, wherein each of the first and second panels portions has inner and outer opposed end edges, the inner end edges of the first and second panel portions disposed side by side adjacent to one another, the inner end edges extending transversely with respect to the free edge, the second fold line being spaced apart from the inner end edge of the first panel portion, the third fold line being spaced apart from the inner end edge of the second panel portion.

14. The carton of claim 13, wherein the second fold line extends from a first point on the first panel portion toward the outer end edge of the first panel portion, the first point being spaced apart from the inner end edge of the first panel portion.

15. The carton of claim 14, wherein the third fold line extends from a second point on the second panel portion toward the outer end edge of the second panel portion, the second point being spaced apart from the inner end edge of the second panel portion.

16. The carton of claim 13, wherein no part of an outline of the second handle flap is disposed in alignment with the inner end edge of the first panel portion.

17. The carton of claim 11, wherein the composite wall is an upright wall, and the second and third fold lines extend upwardly convergently towards one another.

18. The carton of claim 17, wherein the second and third fold lines are disposed adjacent to opposite ends of the first fold line respectively.

19. The carton of claim 11, wherein each of the second and third fold lines is disposed at an angle with respect to the first fold line.

20. The carton of claim 11, wherein part of a free edge of each of the second and third handle flaps is disposed in substantial alignment with the first fold line when the handle is in the unfolded condition.

* * * * *